US011131434B2

(12) United States Patent
Cai et al.

(10) Patent No.: US 11,131,434 B2
(45) Date of Patent: Sep. 28, 2021

(54) LIGHT DEVICE

(71) Applicant: XIAMEN ECO LIGHTING CO. LTD., Xiamen (CN)

(72) Inventors: Lixian Cai, Xiamen (CN); Yongzhe Dong, Xiamen (CN); Xiaoliang Wen, Xiamen (CN); Shoujiang Hou, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/559,665

(22) Filed: Sep. 4, 2019

(65) Prior Publication Data

US 2021/0048158 A1 Feb. 18, 2021

Related U.S. Application Data

(60) Provisional application No. 62/887,585, filed on Aug. 15, 2019.

(51) Int. Cl.

| | |
|---|---|
| ***F21S 8/00*** | (2006.01) |
| ***F21V 23/04*** | (2006.01) |
| ***F21V 3/02*** | (2006.01) |
| ***F21V 23/00*** | (2015.01) |
| *F21Y 115/10* | (2016.01) |

(52) U.S. Cl.

CPC ..... *F21S 8/035* (2013.01); *F21V 3/02* (2013.01); *F21V 23/004* (2013.01); *F21V 23/0471* (2013.01); *F21Y 2115/10* (2016.08)

(58) Field of Classification Search

CPC ..... F21S 8/035; F21V 23/004; F21V 3/02; F21V 23/0471; F21Y 2115/10; F21K 9/23

See application file for complete search history.

(56) References Cited

U.S. PATENT DOCUMENTS

| | | | | |
|---|---|---|---|---|
| 6,346,777 | B1 * | 2/2002 | Kim | H05B 45/395 315/185 S |
| 2004/0231205 | A1 * | 11/2004 | Jen | G09F 19/08 40/431 |
| 2011/0050108 | A1 * | 3/2011 | Lin | H05B 47/155 315/152 |
| 2016/0183740 | A1 * | 6/2016 | Binderbauer | A47K 5/1217 222/52 |
| 2017/0356633 | A1 * | 12/2017 | Volek | F21V 23/0485 |
| 2018/0274776 | A1 * | 9/2018 | Chien | A63H 23/08 |

* cited by examiner

*Primary Examiner* — Rajarshi Chakraborty
*Assistant Examiner* — Glenn D Zimmerman
(74) *Attorney, Agent, or Firm* — Chun-Ming Shih; Lanway IPR Services

(57) ABSTRACT

The light device includes a bottom housing, a container disposed inside the bottom housing, and a light passing shell assembly extended from an opening of the container. A plurality of leaf covers are coupled to the light passing shell assembly. The light device includes a light source assembly capable of emitting light. The light source assembly includes an adjustment device for adjusting a quality of the light emitted by the light source assembly. A plug is attached to the bottom housing for receiving external power and providing power to the light source assembly. A switch is electrically coupled to the adjustment device for adjusting the quality of the light emitted by the light source assembly.

19 Claims, 4 Drawing Sheets

LIGHT DEVICE

BACKGROUND OF THE INVENTION

Field of the Invention

The present invention is related to a light apparatus, and more particularly related to a night light apparatus.

SUMMARY OF THE INVENTION

According to the embodiment of the invention, the light device includes a bottom housing, a container disposed inside the bottom housing, and a light passing shell assembly extended from an opening of the container. A plurality of leaf covers are coupled to the light passing shell assembly. The light device also includes a light source assembly capable of emitting light. The light source assembly includes an adjustment device for adjusting a quality of the light emitted by the light source assembly. A plug is attached to the bottom housing for receiving external power and providing power to the light source assembly. A switch is electrically coupled to the adjustment device for adjusting the quality of the light emitted by the light source assembly.

In the embodiment, the quality of the emitted light is a luminance of the emitted light, or a color temperature of the emitted light.

The light passing shell assembly may further include a fixing device and a shell, the fixing device and the shell form a hollow cylinder body.

According to the embodiment, the light source assembly further includes a control circuit board disposed inside the container, and a light source disposed on the control circuit board.

The light source is driven by a driver circuitry on the control circuit board.

In the embodiment, the light source assembly may further include a proximity sensor for detecting presence of a nearby object, and generating a proximity signal. The proximity sensor may include a body sensor or an infrared sensor. The proximity sensor may be located on the control circuit board. The control circuit board includes a circuitry for providing power to the proximity sensor.

The bottom housing may include a sensing pin hole for receiving external information for the proximity sensor.

The light source and the proximity sensor are located inside the hollow cylinder body.

The adjustment device receives the proximity signal and changes a luminance of the light emitted by the light source accordingly, or changes a color temperature of the light emitted by the light source accordingly, or optionally turns on or turns off the light source accordingly. The adjustment device may be located on the control circuit board In some embodiment, the light source includes a first leaf cover located close to the bottom housing and a second leaf cover located distal to the bottom housing, and the first leaf cover has a larger surface area than the second leaf cover. The first leaf cover and the second leaf cover are stacked from each other with a gap.

In another embodiment, the light source includes a plurality of leaf covers arranged with decreasing surface areas from a first location close to the bottom housing to a second location distal to the bottom housing.

In some embodiment, the light source includes a first leaf cover located close to the bottom housing, a third leaf cover located distal to the bottom housing, and a second leaf cover located between the first leaf cover and the third leaf cover.

The first leaf cover has a first surface area, the second leaf cover has a second surface area, and the third leaf cover has a third surface cover. The first surface area is larger than the second surface area, and the second surface area is larger than the third surface area.

The light passing shell assembly may further include a fixing device and a shell, and the fixing device and the shell form a hollow cylinder body. The third cover leaf further may further include a protection cover for concealing the hollow cylinder body.

DETAILED DESCRIPTION

Figure 1:
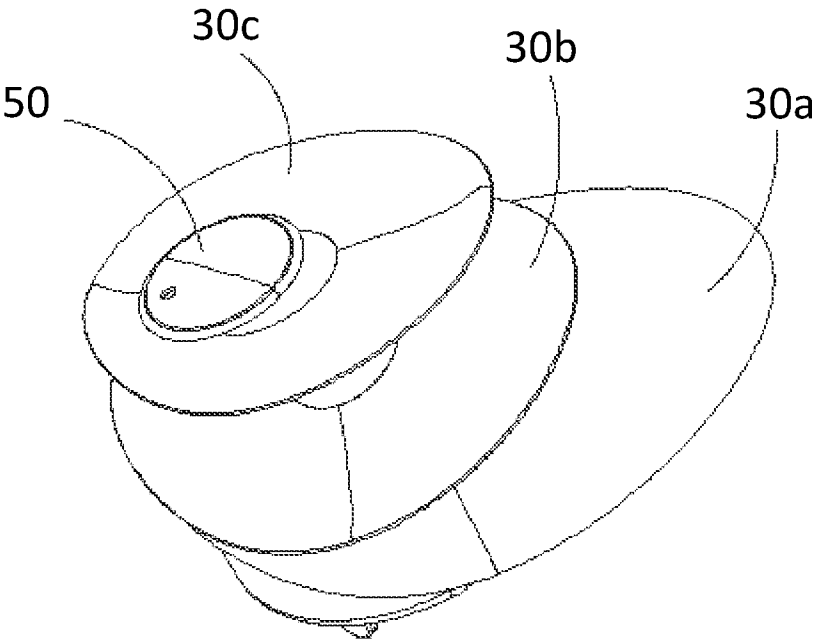
FIG. 1 is a structure diagram of a first embodiment.
Figure 2:
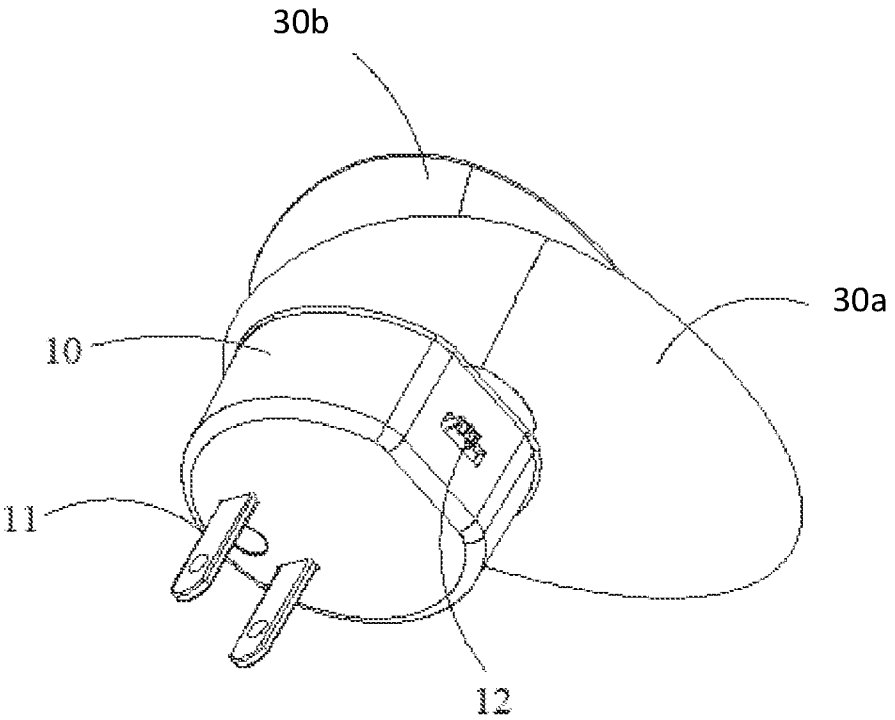
FIG. 2 is a structure diagram of the first embodiment from another viewpoint.
Figure 3:
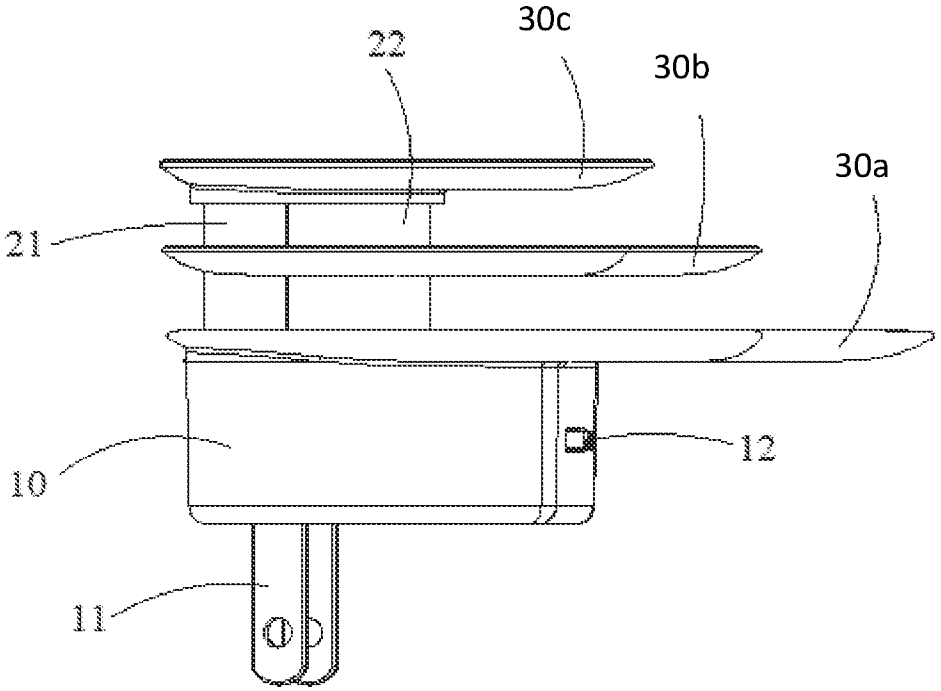
FIG. 3 is a side view of the embodiment.
Figure 4:
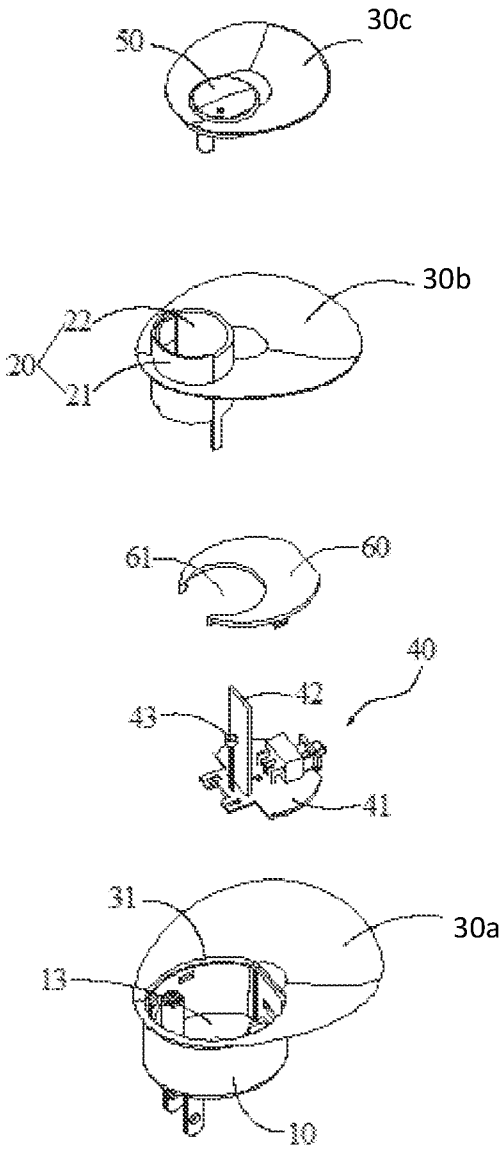
FIG. 4 is an exploded view of the embodiment.

According to the first embodiment, a leaf-style night light device with simple structure and low production cost is provided. Refer to FIG. 1 to FIG. 4. The light device includes a bottom housing 10, a container 13 disposed inside the bottom housing 10, and a light passing shell assembly 20 extended from an opening of the container 13. A plurality of leaf covers 30*a*, 30*b*, and 30*c* are sleeved and coupled to the light passing shell assembly 20. The plurality of leaf covers 30*a*, 30*b*, and 30*c* are stacked one from another with gaps. The light device also includes a light source assembly 40 capable of emitting light. The light source assembly 40 includes an adjustment device for adjusting a quality of the light emitted by the light source assembly 40. A plug 11 is attached to the bottom housing 10 for receiving external power and providing power to the light source assembly 40. A switch 12 is electrically coupled to the adjustment device for adjusting the quality of the light emitted by the light source assembly 40.

In the embodiment, the quality of the emitted light refers to a luminance of the emitted light, or a color temperature of the emitted light. In other words, the switch 12 may send signals to the adjustment device and adjust the luminance or the color temperature of the emitted light.

In one embodiment, the light source assembly 40 includes a first adjustment device for adjusting a luminance level of a light source 42 disposed on the control circuit board 41. The light source 42 includes a plurality of LED chips capable of emitting light of different qualities. The switch 12 is electrically connected to the first adjustment device. The switch 12 is used for adjusting the luminance of the light source 42.

In another embodiment, the light source assembly 40 includes a second adjustment device for adjusting a color temperature of the light source 42 disposed on the control circuit board 41. The switch 12 is electrically connected to the second adjustment device. Specifically, the second adjustment device includes a variable resistor. By using the switch 12 to slide or adjust a resistance of the variable resistor, the color temperature may be adjusted so the light device could provide a soft atmosphere or other desired settings.

The switch 12 may be a sliding switch or a stepless switch.

The light passing shell assembly 20 may further include a fixing device 21 and a shell 22. The fixing device 21 and the shell 22 are clip structures with semi-circular cross section profile together forming a hollow cylinder body. The hollow cylinder body is extended outside an opening of the container 13. The first leaf cover 30*a* is disposed at opening of the container 13. The first leaf cover 30*a* has a connection hole 31 corresponding to the opening of the container 13. There is a protection cover 60 configured for the connection hole 31. A through hole 61 is disposed on the protection cover 60. The light passing shell assembly 20 is extended from the through hole 61. The protection cover 60 protects the components located in the container 13 from dust or other potential damages from the outside.

The second leaf cover 30*b* at the middle level is directly sleeved to the hollow cylinder body.

The shell 22 is disposed closed to an extending direction of the leaf cover 30*a*, 30*b*, 30*c*. The fixing device 21 is used for supporting and fixing the shell 22. The shell 22 allows emitted light from the light source 42 to escape to the leaf covers 30*a*, 30*b*, 30*c* and provide visual layer effects.

In this embodiment, there are three leaf covers 30*a*, 30*b*, and 30*c*. However, the number of leaf covers may be changed in other embodiments.

According to the embodiment, the light source assembly 40 further includes a control circuit board 41 disposed inside the container 13, and a light source 42 disposed on the control circuit board 41. The light source 42 is driven by a driver circuitry located on the control circuit board 41. The light source 42 emits light passing the light passing shell assembly 20 and reaching the two or more leaf covers 30*a*, 30*b*, 30*c* to accomplish visually multiple layer effect.

In the embodiment, the light source assembly 40 may further include a proximity sensor 43 for detecting the presence of nearby objects without any physical contact. The proximity sensor 43 may emit an electromagnetic field or a beam of electromagnetic radiation (infrared, for instance), and looks for changes within the specified range or return signal. The proximity sensor 43 would generate a proximity signal when an object enters within a specified range or when a return signal is received. In some embodiment, the bottom housing 10 includes a sensing pin hole (not shown) for receiving external information for the proximity sensor 43.

The proximity sensor 43 may include a body sensor or an infrared sensor.

According to the embodiment, the proximity sensor 43 may be located on the control circuit board 41.

The control circuit board 41 includes a circuitry for providing power to the proximity sensor 43.

The light source 42 and the proximity sensor 43 may be arranged inside the hollow cylinder body.

In one embodiment, the proximity sensor 43 is electrically coupled to the adjustment device. When the proximity sensor 43 detects the presence of a nearby object, the proximity sensor 43 would generate a proximity signal to the adjustment device to change a luminance of the light emitted by the light source 42 accordingly, or to change a color temperature of the light emitted by the light source 42 accordingly, or to optionally turn on or turn off the light source 42 accordingly.

The adjustment device may be located on the control circuit board 41.

In some embodiments, the light source 42 includes a first leaf cover 30*a* located close to the bottom housing 10 and a second leaf cover 30*b* located distal to the bottom housing 10, and the first leaf cover 30*a* has a larger surface area than the second leaf cover 30*b*.

The leaf covers 30*a*, 30*b*, and 30*c* are stacked from each other with gaps.

The plurality of leaf covers 30*a*, 30*b*, and 30*c* are arranged with decreasing surface areas from a first location close to the bottom housing 10 to a second location distal to the bottom housing 10.

In some embodiment, the light source 42 includes a first leaf cover 30*a* located close to the bottom housing 10, a third leaf cover 30*c* located distal to the bottom housing 10, and a second leaf cover 30*b* located between the first leaf cover 30*a* and the third leaf cover 30*c*. The first leaf cover 30*a* has a first surface area, the second leaf cover 30*b* has a second surface area, and the third leaf 30*c* cover has a third surface cover. The first surface area is larger than the second surface area, and the second surface area is larger than the third surface area.

The light passing shell assembly 20 includes a fixing device 21 and a shell 22, and the fixing device 21 and the shell 22 together form a hollow cylinder body.

In some embodiment, the third cover leaf 30*c* further includes a protection cover 50 for concealing the hollow cylinder body.

In some embodiments, the plug 11 is fixed to the container 13 and extended from a bottom of the bottom housing 10 for connecting to an external power source. The plug 11 is made of metal material and is integrated with the bottom housing 10 by molding package method for fixing these two components together. In some other embodiments, the plug 11 may be disposed by screwing or other fixing structure. In some embodiment, the plug 11 is mounted on a rotatable structure of the bottom housing 10 so that the plug 11 is rotatable with respect to the bottom housing 10 for providing some convenient settings.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

We claim:

1. A light device, comprising:

a bottom housing;

a container disposed inside the bottom housing;

a light passing shell assembly extended from an opening of the container;

a plurality of leaf covers coupled to the light passing shell assembly;

a light source assembly capable of emitting light, the light source assembly includes an adjustment device for adjusting a quality of the light emitted by the light source assembly;

a plug attached to the bottom housing for receiving external power and providing power to the light source assembly;

a switch electrically coupled to the adjustment device for adjusting the quality of the light emitted by the light source assembly, wherein the light source includes a first leaf cover located close to the bottom housing, a third leaf cover located distal to the bottom housing, and a second leaf cover located between the first leaf cover and the third leaf cover, the first leaf cover has a first surface area, the second leaf cover has a second surface area, the third leaf cover has a third surface cover, wherein the first surface area is larger than the second surface area, and the second surface area is larger than the third surface area, wherein the light passing shell assembly further includes a fixing device and a shell, the fixing device and the shell form a hollow cylinder body, wherein the third cover leaf further includes a protection cover for concealing the hollow cylinder body.

2. The light device of claim 1, wherein the quality of the emitted light is a luminance of the emitted light.

3. The light device of claim 1, wherein the quality of the emitted light is a color temperature of the emitted light.

4. The light device of claim 1, wherein the light passing shell assembly further includes a fixing device and a shell, the fixing device and the shell form a hollow cylinder body.

5. The light device of claim 1, wherein the light source assembly further includes a control circuit board disposed inside the container and a light source disposed on the control circuit board.

6. The light device of claim 1, wherein the light source includes a first leaf cover located close to the bottom housing and a second leaf cover located distal to the bottom housing, wherein the first leaf cover has a larger surface area than the second leaf cover.

7. The light device of claim 1, wherein the plurality of leaf covers are stacked from each other with gaps.

8. The light device of claim 1, wherein the plurality of leaf covers are arranged with decreasing surface areas from a first location close to the bottom housing to a second location distal to the bottom housing.

9. The light device of claim 5, wherein the light source is driven by a driver circuitry on the control circuit board.

10. The light device of claim 5, wherein the light source assembly further includes a proximity sensor for detecting presence of a nearby object, and generating a proximity signal.

11. The light device of claim 5, wherein the adjustment device is located on the control circuit board.

12. The light device of claim 10, wherein the proximity sensor includes a body sensor or an infrared sensor.

13. The light device of claim 10, wherein the proximity sensor is located on the control circuit board.

14. The light device of claim 10, wherein the bottom housing includes a sensing pin hole for receiving external information for the proximity sensor.

15. The light device of claim 10, wherein the control circuit board includes a circuitry for providing power to the proximity sensor.

16. The light device of claim 10, wherein the light source and the proximity sensor are located inside a hollow cylinder body.

17. The light device of claim 10, wherein the adjustment device receives the proximity signal and changes a luminance of the light emitted by the light source accordingly.

18. The light device claim 10, wherein the adjustment device receives the proximity signal and optionally turns on or turns off the light source accordingly.

19. The light device of claim 10, wherein the adjustment device receives the proximity signal and changes a color temperature of the light emitted by the light source accordingly.

* * * * *